US005211554A

United States Patent [19]

Rajewski

[11] Patent Number: 5,211,554

[45] Date of Patent: May 18, 1993

[54] DETONATION ARRESTOR WITH STACKED PLATES

[76] Inventor: Robert K. Rajewski, R.R. #1, Donalda, Alberta, Canada, T0B 1H0

[21] Appl. No.: 914,412

[22] Filed: Jul. 17, 1992

Related U.S. Application Data

[63] Continuation-in-part of Ser. No. 659,272, Feb. 22, 1991, Pat. No. 5,145,360.

[30] Foreign Application Priority Data

Apr. 29, 1992 [CA] Canada ..... 2067612

[51] Int. Cl.[5] ..... F23D 14/82

[52] U.S. Cl. ..... 431/346; 48/192; 220/88.2

[58] Field of Search ..... 431/346; 48/192; 220/88.2

[56] References Cited

U.S. PATENT DOCUMENTS

| | | | |
|---|---|---|---|
| 58,055 | 9/1866 | Boynton | 48/192 |
| 290,559 | 12/1883 | Finnigan | 220/88.2 |
| 1,328,485 | 1/1920 | Berry | 48/192 |
| 1,755,624 | 4/1930 | Yount | 220/88.2 |
| 1,907,976 | 5/1933 | Jones | 48/192 |
| 2,068,421 | 1/1937 | Long et al. | 220/88.2 |
| 2,277,294 | 3/1942 | Brooks | 48/192 |
| 2,420,599 | 5/1947 | Jurs | 48/192 |
| 2,810,631 | 10/1957 | Kanenbley | 48/192 |
| 3,148,962 | 9/1964 | Dellinger et al. | 48/192 |
| 3,238,027 | 3/1966 | Dellinger et al. | 48/192 |

*Primary Examiner*—Carroll B. Dority
*Attorney, Agent, or Firm*—Anthony R. Lambert

[57] ABSTRACT

A detonation arrestor for a line carrying a combustible gas includes a cell housing having a particulate quenching medium composed of alumina ceramic beads. The media is held in place by a plurality of stacked plates. The detonation arrestor is symmetrical and may be placed in the flare line in either direction. A deflector ring encircles the interior of the cell housing and prevents flame fronts from flashing along the edge of the cell housing.

7 Claims, 3 Drawing Sheets

DETONATION ARRESTOR WITH STACKED PLATES

CROSS-REFERENCE TO RELATED APPLICATIONS

This is a continuation in part of co-pending application Ser. No. 07/659,272, filed Feb. 22, 1991, now U.S. Pat. No. 5,145,360.

FIELD OF INVENTION

This invention relates to detonation arrestors.

BACKGROUND OF THE INVENTION

Detonation arrestors are used in flare lines or relief lines where flammable gases are being vented or discharged for burning. They may also be used in sewage lines and in lines in furnaces, or in any other line in which combustible gases flow. The flammable gases that are being conveyed by the line can sometimes be enriched with oxygen, causing a dangerous condition in which there is potential for an explosion, detonation or other flame front movement in the line. Such an event will be referred to as a flame front. The flame front may travel through the line towards the source of the flammable gases, which may be a storage tank containing flammable gases.

It is therefore highly desirable to have a device in the line that is capable of extinguishing such a flame front as it travels down the line. The device must be designed to extinguish a variety of flame fronts including a continuous burn. At the core of such a device is a part that is known as the quenching medium, and various designs have used different such media. The quenching medium is used to extinguish or in other words quench the flame.

Devices presently on the market that are used as detonation arrestors include a device having a quenching medium made of tightly wound expanded metal (aluminum mesh) made by Westech Industrial Ltd. of Sherwood Park, near Edmonton, Canada. The quenching medium includes a core made from fine expanded metal mesh that is rolled into a cylindrical shape, and has its ends cast in liquid steel. Gas passes through the mesh, and while it is useful for stopping detonations, has difficulty withstanding a continuous burn. In a continuous burn, the flame tends to stabilize on the surface of the cell and the aluminum of the expanded metal mesh tends to melt.

Another device is the Enardo TM flame arrestor made by Enardo Manufacturing Co. of Tulsa, Okla. The flame cell of the Enardo flame arrestor is said to be of the wound crimped ribbon type and is said to be custom wrapped to the customer's specifications. A spacer sheet, a sheet of metal formed by crimping, is wrapped with a flat sheet to form the correct diameter cell. This arrestor is said to be designed to separate the flame front into numerous small channels of a preselected dimension which are intended to extinguish the flame front.

In the inventor's co-pending application Ser. No. 07/659,272, now U.S. Pat. No. 5,145,360, the inventor has proposed a detonation arrestor for connection to a flare line that includes a cell housing defining an interior cavity filled with a particulate quenching medium. First and second flame front diffusors are disposed between the cell housing and the lines to which the arrestor is attached. The particulate quenching medium as described includes a plurality of heat absorbing and corrosion resistant balls, particularly stainless steel balls, and the cell housing includes a deflector ring disposed around the inner circumference of the cavity in the cell housing and extending into the particulate quenching medium. The cell housing also includes a filling pipe for filling the cavity with particulate quenching medium, the deflector ring being located half-way across the entry of the filling pipe into the cavity. In this latter embodiment, the first flame front diffusor may be a steel plate having a diameter greater than the diameter of the outflow line, or may include a particulate quenching medium, which itself is preferably a set of stainless steel balls. The stainless steel balls are retained in place by a wire mesh supported by flat bars with their short faces abutting against the wire mesh. Cross-supports supporting the flame front diffusor may then be oriented at right angles to the flat bars for maximum strength.

In this patent document, the inventor proposes improvements to the design of the detonation arrestor, including offsetting the entry of the line into the flame arrestor and providing an inspection port for inspecting the interior of the detonation arrestor. The inventor has also found that alumina ceramic beads are a superior quenching medium to stainless steel balls.

Further, the inventor has found that he can do without the flame front diffusor and the wire mesh supporting the quenching medium by using a plurality of closely spaced steel bars stacked parallel to each other on either side of the cell housing. Closely spaced means closer than the expected smallest diameter of the alumina ceramic beads, and preferably much closer than the thickness of the bars themselves.

The inventor has found that the steel bars absorb the heat of a flame front and that the beads also absorb the heat and extinguish the flame. A detonation arrestor with the ceramic beads and the stacked plates provides excellent resistance to a continuous burn, with burn times in excess of one hour before experiencing burn back.

In accordance with one aspect of the invention there is therefore provided a detonation arrestor for connection to a line carrying combustible gases, the line having inflow and outflow ends to which the detonation arrestor is attached, and including a cell housing defining an interior cavity in fluid connection with the line, a plurality of stacked plates secured within the cell housing and enclosing the interior cavity, with the shorter sides of the plates being oriented end on to the flow of gas, each of the stacked plates being separated by a distance smaller than their individual thickness, and a particulate quenching medium substantially filling the interior cavity between the stacked plates. The detonation arrestor preferably includes crimped ribbon separating adjacent ones of the stacked plates.

An inspection port is preferably included at each end of the cell housing and the inflow and outflow lines are offset from the center of the cell housing, and set at a lower point to facilitate draining of fluids from the cell housing.

By contrast with the Enardo and Westech devices referred to above, the devices described here, having particulate queching medium, do not have continuous passageways passing straight through the arrestor through which the flame front can pass.

BRIEF DESCRIPTION OF THE DRAWINGS

There will now be described preferred embodiments of the invention with reference to the drawings by way of illustration, in which like numerals denote like elements, and in which.

DETAILED DESCRIPTION OF THE PREFERRED EMBODIMENTS

Figure 1:
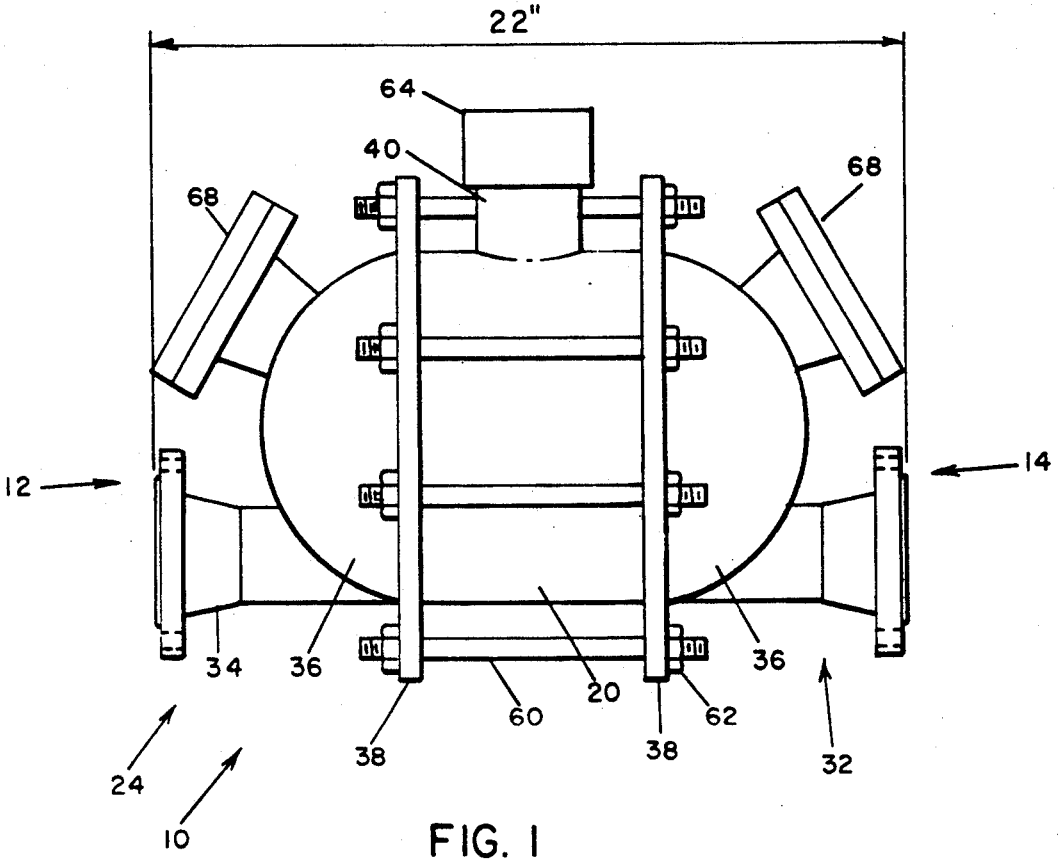
FIG. 1 is a side view of a detonation arrestor having a cell housing without stacked plates.
Figure 2:
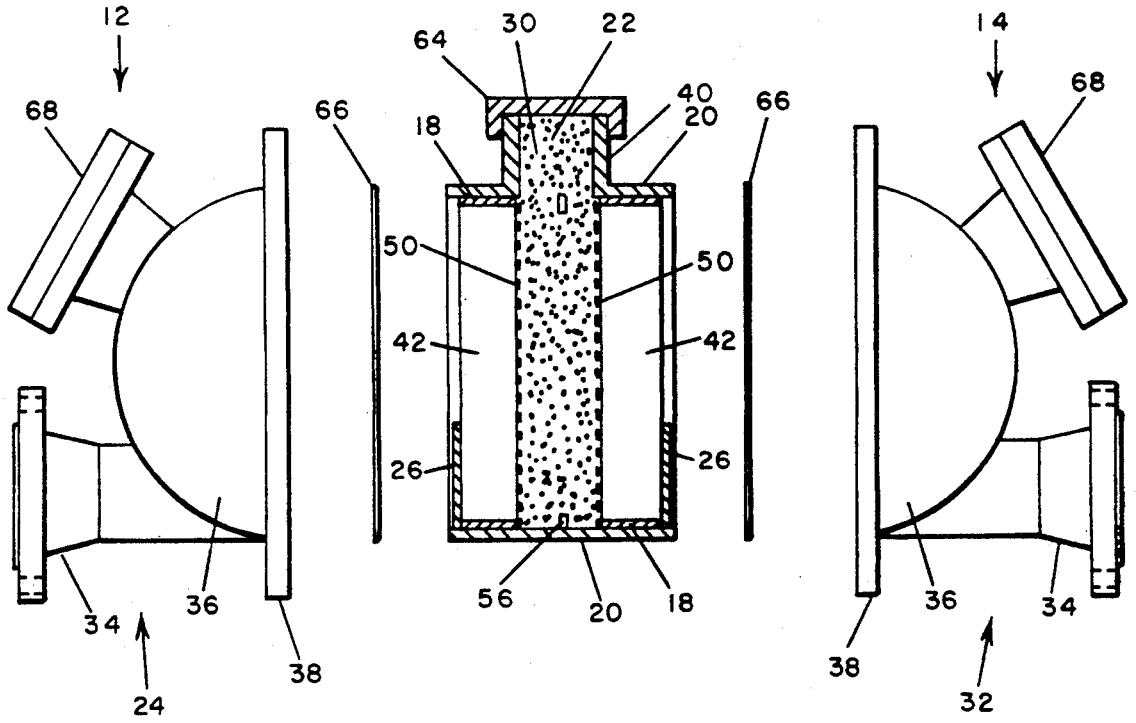
FIG. 2 is a side exploded view, partly in cross-section, of the detonation arrestor of FIG. 1.

Referring to FIGS. 1 and 2 there is shown a detonation arrestor generally labelled 10 which incorporates improvements to the arrestor shown in co-pending application, No. 07/659,272, now U.S. Pat. No. 5,145,360. This detonation arrestor is preferably made symmetrically so that it may be inserted into a flare line or some other line carrying combustible gases for normal operation with flow either way through it. That is, the end 12 is identical to the end 14, and only one end will be described in detail.

FIG. 2 illustrates a cell housing for use in the detonation arrestor of FIG. 1. The detonation arrestor 10 is designed for connection to a line (not shown) in which the line has inflow and outflow ends (not shown). The major components of the detonation arrestor 10 are a cell housing 20 defining an interior cavity 22 in fluid connection with the inflow and outflow ends of the line. On one side of the cell housing 20 is a first means 24 attached to the cell housing 20 for securing the detonation arrestor 10 to the outflow end of the flare line. A flame front diffusor 26 is disposed in one end of the first means 24 in line with the line and adjacent the cell housing 20. The cell housing 20 includes a particulate quenching medium not shown substantially filling the interior cavity 22. On the other side of the cell housing is a second means 32 attached to the cell housing 20 for securing the detonation arrestor 10 to the inflow end of the line.

The first means 24 includes a raised face weld neck flange 34, with attached pipe, semi-spherical weld cap or end cap 36, and flat face slip on flange 38 into which the weld cap 36 slips. The interior of the flange 34 is a straight pipe, although the outside is shown as being conical. The preferred flame front diffusor 26 shown in FIG. 2 is a ¼" flat piece of steel larger in diameter than the interior diameter of the line, and preferably at least 1" to 1½" larger in diameter than the interior diameter of the line. In this case the flame front diffusor is circular and about 4" in diameter. The flame front diffusor 26 is supported on backing bars 42 (same as those illustrated in FIG. 5, except that in this design the backing bars are secured to the inside cell housing 18). The inside cell housing 18 is secured inside the cell housing 20, with the ends of the cell housing 20 extending slightly beyond the ends of the inside cell housing 18. The flame front diffusor 26 should have space around it to allow gases to circulate around it and spread out before contacting the cell housing and the particulate quenching medium contained within the cell housing.

Figure 5:
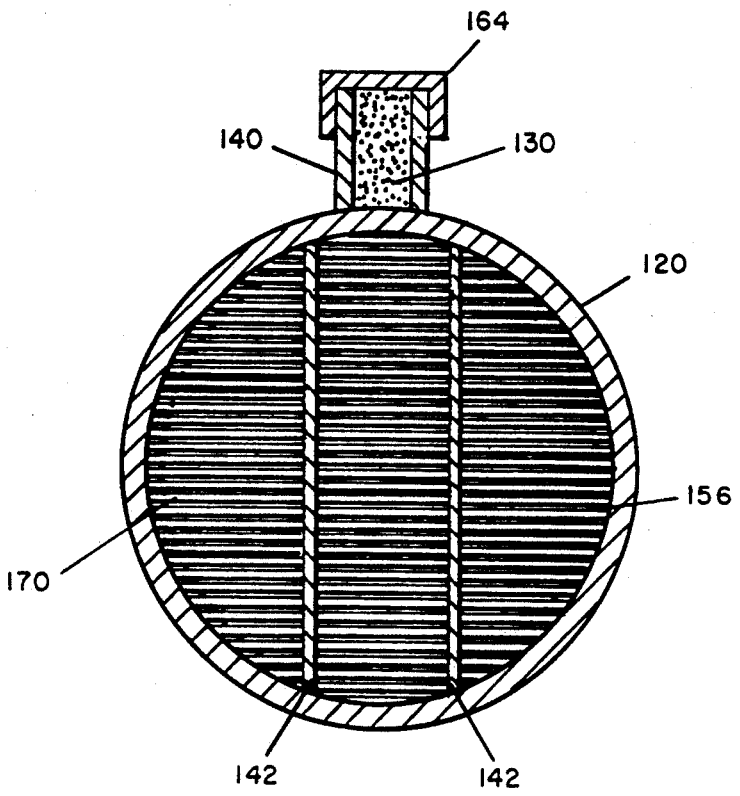
FIG. 5 is a front view of a plurality of stacked plates within the cell housing of the detonation arrestor shown in FIG. 3.

The cell housing of FIG. 2 includes two pairs of backing bars 42, similar to those shown in FIG. 5. One pair of backing bars is located on each side of the interior cavity 22. A particulate quenching medium 30 fills the interior of the cavity 22 and is held in place by stainless steel mesh 50. The stainless steel mesh 50 abuts against and is held in place by the backing bars 42. The wire mesh 50 should be oriented so that its wires are at 45° angles to the orientation of the backing bars 42.

The backing bars, which are flat bars of metal, are preferably oriented with their short faces abutting against the wire mesh and flame front diffusor respectively, that is, with their intermediate dimension parallel to the direction of flow, to add to the strength of the cell assembly under detonation, and to reduce resistance to the flow of gas through the arrestor.

As shown in Fig. 2, a deflector ring 56 is provided around the inside circumference of the cell housing 20. This deflector ring 56 is preferably located half-way across the entry of the filling pipe 40 into the cavity so that on filling the cavity 22 with particulate quenching medium, the particulate quenching medium fall more or less equally on each side of the deflector ring 56. The deflector ring 56 should have a snug fit with the inner diameter of the cell housing 20 so that the flame front cannot pass between them. There will be an exception at the filling pipe to this snug fit, but this is not a problem as long as there is particulate quenching medium around the edge of the deflector ring 56 at the filling pipe 40 through which the flame front can pass. The deflector ring 56, like all other internal parts referred to here, should be welded in place. The deflector ring should be large enough to deflect a flame front into the stainless steel balls. For the exemplary embodiment described here, a ring sticking out ½" into the particulate quenching medium has been found adequate.

If desired, the deflector ring 56 may have attached to it (or forming part of it) a tongue (not shown) that extends into the filling pipe 40. The tongue may be welded to the edges of the filling pipe 40 to provide a seal between the tongue 57 and the pipe 40. Below the tongue, the ring 56 may extend about a further ½" into the interior of the cell housing and form a ⅜ crescent barrier. The detonation arrestor is secured together with studs 60 and nuts 62 passing through appropriate openings in the flanges 38. A cap 64 closes the filling pipe. A coupler and plug drain (not shown) is also provided for draining liquid contaminants from the cell housing 20. Inspection ports 68 are provided on the end caps 36 so that the interior of the cell housing can be inspected for damage and contamination.

Figure 3:
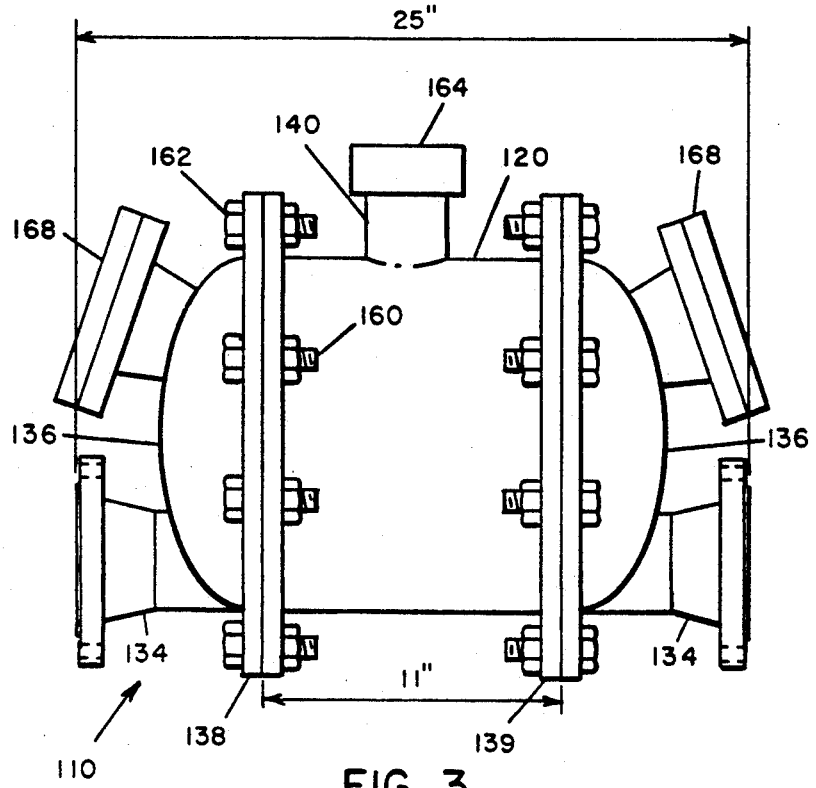
FIG. 3 is a side view of a detonation arrestor having stacked plates.
Figure 4:
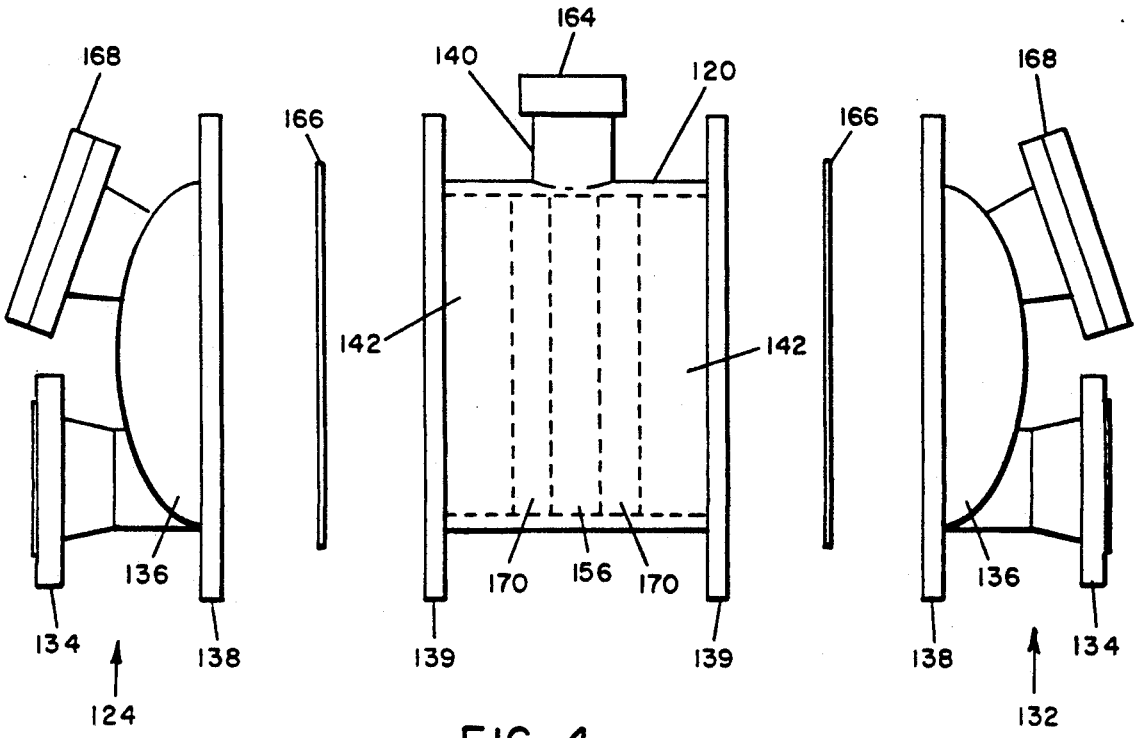
FIG. 4 is a side exploded view, partly in cross-section (dotted lines), of the detonation arrestor of FIG. 3.
Figure 6:
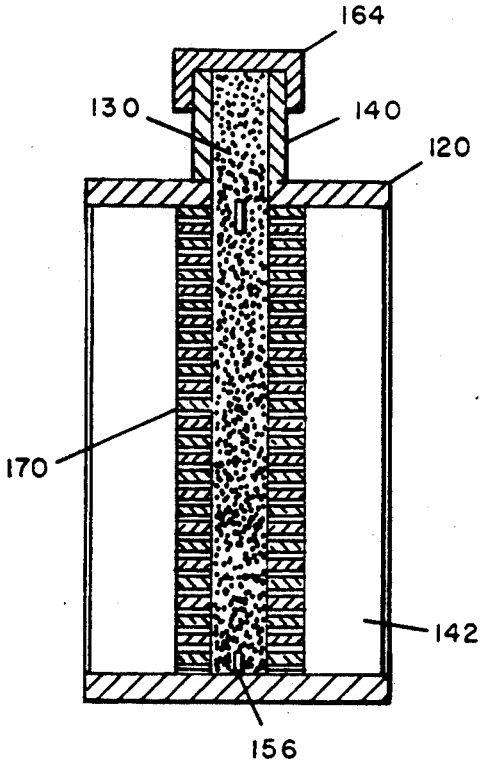
FIG. 6 is a cross-section of the cell housing of FIG. 4.

The design of the cell housing shown in FIGS. 3 and 4 is similar to that shown in FIGS. 1 and 2. The detonation arrestor 110 is designed for connection to a line (not shown) in which the line has inflow and outflow ends (not shown). The major components of the detonation arrestor 110 are a cell housing 120 defining an interior cavity 122 in fluid connection with the inflow and outflow ends of the line. On one side of the cell housing 120 is a first means 124 attached to the cell housing 120 for securing the detonation arrestor 110 to the outflow end of the line. The cell housing 120 includes a particulate quenching medium 130 substantially filling the interior cavity 122 (FIG. 6). On the other side of the cell housing is a second means 132 attached to the cell housing 120 for securing the detonation arrestor 110 to the inflow end of the line.

The first means 124 includes a raised face weld neck flange 134, semi-spherical weld cap or end cap 136, and flat face slip on flange 138 into which the weld cap 136 slips, similar to the ones shown in FIGS. 1 and 2.

Figure 7:
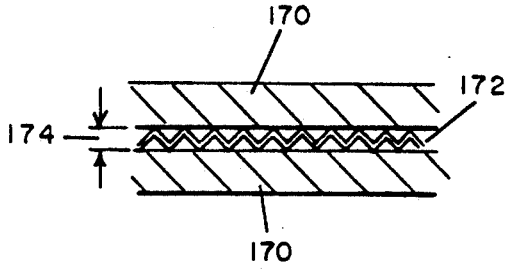
FIG. 7 is a section of the stacked plates perpendicular to the flow of gas showing adjacent stacked plates and crimped ribbon between them.

The cell housing of FIG. 4 includes two pairs of backing bars 142 as shown in FIG. 5. The backing bars 142 are welded to the inside of the cell housing 120. One pair of backing bars is located on each side of the interior cavity 122. A particulate quenching medium 130 fills the interior of the cavity 122 and is held in place by a plurality of ⅛"×1.5" plates 170 stacked together and evenly separated by about 0.055". As shown in FIG. 7, the space between each of the stacked plates 170 is partially filled with a 0.008" thick ×1.5" wide stainless steel crimped ribbon 172 that has been crimped to a thickness of 0.055" (the preferred angle of the crimp is 45°). The plates 170 are welded to the inside of the cell housing 120. The stacked plates 170 extend entirely across the cell housing (meaning from top to bottom as well as from side to side), as shown in FIG. 5, and thus enclose the interior cavity so that any gas flowing through the detonation arrestor must pass through one of the 0.055" gaps 174 (see FIG. 7) between adjacent plates.

The backing bars 142, which are flat bars of metal, are preferably oriented with their short faces abutting against the short faces of the stacked plates 170. The intermediate dimension of each of the backing bars 142 and the stacked plates 170 is parallel to the direction of flow, to add to the strength of the cell assembly under detonation, and to reduce resistance to the flow of gas through the arrestor. Small deviations from this orientation of the plates are acceptable.

As shown in FIGS. 4 and 6, a deflector ring 156 is provided around the inside circumference of the cell housing 120, having the same structure and function as the deflector ring 56 shown in FIG. 2 and described above, and, as with the deflector ring 56 may include a tongue (not shown) that extends into the filling pipe 140 and a ⅜ crescent barrier, both of which are described above. The detonation arrestor is secured together with studs 160 and nuts 162 passing through appropriate openings in the flange 38. Unlike the arrestor shown in FIGS. 1 and 2, however, the cell housing 120 includes a pair of flanges 139 which are secured to the flanges 138 with the studs 160 and nuts 162, with a gasket 166 between them. Inspection ports 168 are provided on the end caps 136 so that the interior of the cell housing can be inspected for damage and contamination. If the channels formed by the crimped ribbon become damaged, the ribbon should be replaced, and if the channels become contaminated, then they should be cleaned.

Alumina ceramic is preferred for the particulate quenching medium 30 and 130. The alumina ceramic is preferably ⅛" 98% high alumina ceramic beads available from Coors Ceramic of Boulder, Colorado, USA. Such beads are believed to be able to withstand temperatures of 3400° F. It has been found that it is preferable that the beads have slightly different sizes so that they tend not to stack in symmetrical layers. Uneven stacking allows greater flow rates through the cell housing. The particulate quenching medium 130 should substantially fill the cavity 122, and while a ⅛" size is preferred for the size of detonation arrestor shown, should have a size chosen to suit a particular use. Large size is preferred to allow large volume flow of gas, but small size is preferred for increased heat absorption by the alumina ceramic beads.

The alumina ceramic beads are chosen for their functional characteristics, namely high heat absorption, the ability to withstand high temperatures, the ability to withstand corrosion and the ability to pack with numerous small holes between the beads. The beads should not be so irregular in size so as not to leave appropriate holes for the flow of gas.

The cell housing size is somewhat dependent on the size of particle used. As the size of the particle decreases, the pressure drop across the detonation arrestor increases, and hence for a given flow rate of gas, the cell housing diameter must be increased. The proper dimension of the cell housing may be readily determined from the flow rate of gas in the line, the diameter of the flow line and the pressure drop across the detonation arrestor. For example, a 20" line may require a 48" diameter housing, with the housing being 6 to 8" thick.

Second means 32 and 132 attached to the cell housings 20 and 120 respectively for securing the detonation arrestor to the inflow end of the line is preferably similarly constructed to the respective first means since then the detonation arrestor works with flow both ways through it and the person doing installation need not worry which end is which. The inlet and outlet ends 24, 32, 124 and 132 are offset from center on the end caps to allow for drainage of fluids from the arrestor.

The detonation arrestor is believed to work as follows. In normal operation gas flows through the line and into the weld cap 36 or 136, as the case may be. In each of the designs shown, the gas passes from there through the particulate quenching medium and out of the cell housing, and into the outflow line.

In the weld cap 36, the gas also collides with the diffusor 26. Sound waves resulting from the collision with the diffusor help spread out the incoming gas around the diffusor 26.

When a detonation or travelling flame front occurs in the line, it normally travels against the flow of gas, from the outflow line to the inflow line, and normally is concentrated around the sides of the pipe.

In the case of the detonation arrestor of FIGS. 1 and 2, when the flame front reaches the flame front diffusor (it travels faster than sound and so is ahead of any sound wave), it collides with the flame front diffusor, transferring energy in the form of heat to the diffusor and then travels around the diffusor towards the particulate quenching medium. On colliding with the particulate quenching medium, preferably alumina ceramic, in the cell housing, the flame front begins a tortuous path through the particles and continues to transfer heat to the metal of the particles. As heat is transferred, if a sufficiently thick medium is chosen, the flame will be extinguished.

In the case of the arrestor shown in FIGS. 3 and 4, the flame front expands in the end cap 132 and passes into the spaces between the stacked plates 170. The plates 170 cool the flame front and during the first stage of a burn also extinguish the flame front. During a prolonged burn, the plates 170 heat up and the flame front may pass into the particulate quenching medium, which finally extinguishes the flame as described above. The stacked plates 170 on the other side of the cell housing also help to eliminate any possibility that an explosion will propagate across the detonation arrestor, and, along with the symmetrical design of the arrestor, permit the detonation arrestor to be located in the line either facing one way or the other.

The plates 170 should be closer than the thickness of the beads to keep them in the cell. However, the plates 170 should not be so close as to restrict the flow of gas. Also, if the plates 170 are too far apart, then the burn time will be reduced. It is desirable to increase the burn time as much as possible. The burn time is the time in which the detonation arrestor can sustain a continuous burn without becoming damaged so that it no longer functions properly. Once the beads are subject to a continuous burn, they do not last long, and therefore it is desirable that the plates absorb as much heat as possible.

The deflector ring 56 or 156 in the cell housing serves to prevent flame from flashing along the edge of the cell housing. Since the particles at the edge of the cavity abut against the cell housing interior surface, rather than interleave with other particles, the area closely adjacent the interior surface of the cell housing is where the flame front may most readily move. Further, settling of the particles may occur in the cavity 22 or 122, leaving a gap at the top of the cell housing between the particles and the cell housing itself. Flame may pass along this gap, thus defeating the purpose of the detonation arrestor. In either case, the deflector ring serves to deflect the flame front into the particles. For most of the circumference of the deflector ring, the deflection is towards the interior of the cavity, and at the filling pipe is both towards the interior and into the particles in the filling pipe. The resulting deflection of the flame front allows the particles to cool and dissipate the flame. A tongue (if used) also helps to prevent flame from moving around the deflector ring 56 or 156 in the filling pipe 40 or 140, and the crescent barrier (if used) also helps prevent settling of the particulate quenching medium from allowing a clear passage across the top of the interior of the housing just below the inside edge of the deflector ring 56 or 156.

Filling of the cell housing should be done carefully to ensure that the cavity 22 or 122 is completely filled, including the filling pipe. In the case of the device shown in FIGS. 1 and 2, after several detonations, the wire mesh 50 will likely have pushed into the gaps created by the backing bars 52, thus providing more room for the particles to settle. The filling pipe provides a reservoir to help offset any such settling.

The particles are poured into the cavity, and the detonation arrestor shaken to promote optimal settling of the particles. As the flame front passes through the particles, it separates adjacent beads, thus converting some energy to kinetic energy of the particles, and the particles heat up, thus dissipating some of the flame front energy. The heat capacity of the detonation arrestor described here, using the alumina ceramic beads, is believed to be so great that it can dissipate the heat of a continuous burn, and effectively withstand such a burn for a long period. The barrier ring 56 or 156 is also believed to help stop flame stabilization, by eliminating a clear passage for the flame front to stabilize in.

The cavity 22 or 122 should be at least 1½" thick with alumina ceramic beads of ⅛" diameter. For larger size lines, increased thickness is desirable.

For maintenance when the detonation arrestor is installed in a line or other line carrying flammable gas, the nuts may be taken off the studs and spreader bars used to separate the flanges 138 from the flanges 139 of the cell housing. The cell housing may then be dropped out of the remainder of the arrestor (which remains in line). The preferred parts used in the detonation arrestors described above (3" model) are as follows:

| Item (FIG. 1 and 2) | Description |
|---|---|
| FLANGE 34 | 3" STD A105 150# RFWN with 3" STD A106B SMLS PIPE EXTENSION |
| WELD CAP 36 | 12" STD A234 WPB |
| FLANGE 38 | ¾" THK A36 CS PL FLANGE |
| GASKETS 66 | 12.75" GARLOCK* GASKETS (TM OF GARLOCK OF CANADA LTD., of Edmonton, Alberta) |
| CELL HOUSING 20 | 12" STD A 106B SMLS |
| WIRE MESH 50 | #6 STAINLESS STEEL |
| BACKING BARS 42 | ⅜" × 3" A36 CS |
| FLAME FRONT DIFFUSOR 26 | ¼" × 4" DIA A36 CS |
| NUTS 62 | A194-2HM NUTS |
| STUDS 60 | ¾" DIA A193-B7M STUDS |
| FILLING PIPE 40 | 3" NPT 2000# FS |
| CAP 64 | ¾" NPT 2000# FS COUPLING W CAP |
| RING 18 | ¼" × 2" FLAT 304 SS ROLLED TO FIT INSIDE CELL HOUSING |
| DEFLECTOR RING 56 | ⅛" × ½" 304 SS |
| INSPECTION PORT 68 | 3" A105 150# RFWN FLANGE W BLIND FLANGE |

| Item (FIGS. 3-6) | Description |
|---|---|
| FLANGE 134 | 3" STD A105 150# RFWN with 3" STD A106B SMLS PIPE EXTENSION |
| WELD CAP 136 | 12" STD A234 WPB |
| FLANGE 138, 139 | ¾" A36 CS PLATE FLANGE |
| GASKETS 166 | 12" ⅛" 150# GARLOCK* GASKETS (TM OF GARLOCK OF CANADA LTD., of Edmonton, Alberta) |
| CELL HOUSING 120 | 12" STD A 106B SMLS PIPE CELL HOUSING × 10.25" LONG |
| BACKING BARS 142 | ½" × 3" FLAT A36 CS BACKING BARS |
| NUTS 162 | ¾" |
| STUDS 160 | ¾" × 3.5" BOLTS |
| FILLING PIPE 140 | 2" NPT 2000# FS COUPLING |
| CAP 164 | 2" NPT FS HEX HEAD PLUG |
| DEFLECTOR RING 156 | ⅛" × ½" 304L SS |
| INSPECTION PORT 168 | 3" A105# RFWN FLANGE W BLIND FLANGE |

While preferred embodiments have been described and claimed, immaterial modifications could be made to these embodiments without departing from the invention.

I claim:

1. A detonation arrestor for connection to a line carrying flammable gas, the line having inflow and outflow ends, comprising:

a cell housing defining an interior cavity in fluid connection with the line;

first means attached to the cell housing for securing the detonation arrestor to the outflow end of the line;

first and second sets of stacked plates secured within the cell housing and enclosing the interior cavity, each of the stacked plates being separated by a distance smaller than their individual thickness and having a shorter side, the shorter side being oriented end on to the flow of gas;

the cell housing including a particulate quenching medium substantially filling the interior cavity between the first and second sets of stacked plates; and second means attached to the cell housing for securing the detonation arrestor to the inflow end of the line.

2. The detonation arrestor of claim 1 in which the particulate quenching medium includes a plurality of alumina ceramic beads.

3. The detonation arrestor of claim 2 further including a deflector ring disposed around the inner circumference of the cavity in the cell housing and extending into the particulate quenching medium.

4. The detonation arrestor of claim 3 further including a filling pipe for filling the cavity with particulate quenching medium, the deflector ring being located half-way across the entry of the filling pipe into the cavity.

5. The detonation arrestor of claim 3 in which the particulate quenching medium is retained in place only by the stacked plates.

6. The detonation arrestor of claim 1 further including crimped ribbon separating adjacent ones of the stacked plates.

7. The detonation arrestor of claim 1 further including an inspection port in at least one of the first means and the second means.

* * * * *